United States Patent [19]

Bright

[11] 4,036,152

[45] July 19, 1977

[54] REFUSE COMPACTOR-INCINERATOR DISPOSER

[75] Inventor: James A. Bright, Dayton, Ohio

[73] Assignee: General Motors Corporation, Detroit, Mich.

[21] Appl. No.: 632,494

[22] Filed: Nov. 17, 1975

[51] Int. Cl.[2] ..... F23G 5/10

[52] U.S. Cl. ..... 110/8 E; 110/8 P; 110/18 E

[58] Field of Search ..... 110/8 R, 8 C, 8 E, 8 P, 110/18 R, 18 C, 18 E

[56] References Cited

U.S. PATENT DOCUMENTS

| | | | |
|---|---|---|---|
| 2,978,999 | 4/1961 | Smith | 110/18 |
| 3,357,376 | 12/1967 | Miller | 110/8 |
| 3,357,379 | 12/1967 | Wiley, Jr. | 110/8 |

*Primary Examiner*—Kenneth W. Sprague
*Attorney, Agent, or Firm*—Edward P. Barthel

[57] ABSTRACT

A solid refuse compactor-incinerator disposer which includes a cabinet housing with a refractory bottom wall and a ram mounted in the housing for vertical reciprocal movement. A drawer, with a refuse receiving container, is slidable into and out of the housing between a closed compacting-incinerating position beneath the ram and an open refuse receiving position outwardly of the housing. An incinerator combustion chamber is formed by an insulated sleeve resiliently mounted on the drawer frame while a refractory insulated chamber top wall is in turn resiliently mounted between the ram and the housing with the top wall biased downwardly causing the top wall to depress the sleeve into engagement with the bottom wall upon the ram's initial descent defining the combustion chamber. Heating means in the combustion chamber are controlled to provide a pyrolysis condition to reduce the compacted refuse to ash while gases given off during the process are mixed with room air and passed through a catalyst to completely burn same and eliminate smoke, odor and harmful pollutants. The burned gases are then mixed with a large quantity of outside air before being vented to the atmosphere.

4 Claims, 7 Drawing Figures

REFUSE COMPACTOR-INCINERATOR DISPOSER

This invention relates to a refuse compactor-incinerator disposer and more particularly to a domestic compactor-incinerator appliance for reduction of household refuse material to a clear ordorless gas with a minimum of ash.

The presently used commercial refuse compactors, such as the domestic compactor shown in U.S. Pat. Nos. 3,741,108 and 3,821,927, both issued to J. F. Stratman et al., compact and store solid waste for one to two weeks for an average-size family. Such compactors comprise a ram mounted in a housing for vertical reciprocal movement and a refuse receptacle in the form of a drawer. The drawer-receptacle is slidable from a refuse loading position outside the housing to a compacting position within the housing beneath the ram, allowing the ram to be lowered into the drawer and compact waste material deposited therein. In the above-mentioned prior art patented compactors, the refuse must be collected in a disposable plastic bag in the drawer whereby the compacted refuse is removed by the removal of the bag and collected for disposal by such means as sanitary landfills, open dumping, incineration, composting, recycling and the like.

It is an object of the present invention to provide a solid waste compactor-incinerator disposer which compacts and stores solid waste in an insulated drawer structure which upon being closed forms with insulated portions of the housing a compaction and incineration or combustion chamber whereby after the compacted trash is accumulated it is raised to a pyrolysis temperature. The trash, with the exception of glass and metal, is reduced to ash and a clear odorless gas.

It is another object of the present invention to provide a refuse compactor-incinerator disposer including a housing with a refractory bottom wall having a ram plate mounted in the housing for vertical reciprocal movement and a refuse receiving drawer including a combustion chamber defined by an insulated sleeve resiliently mounted on the drawer frame. The chamber sleeve upper end is closed by an insulated top wall resiliently mounted between the ram plate and the housing, such that the top wall is biased downwardly on the elevated ram plate so that the top wall descends upon initial lowering the ram plate to engage the sleeve upper end causing them to descent upon continued lowering of the ram plate whereby the sleeve lower end engages the bottom wall to define the sealed combustion chamber. Top and bottom heaters raise the temperature in the chamber to a predetermined level wherein a pyrolysis process occurs decomposing the trash and reducing same to a clear odorless gas with an ash residue, while the gases given off during the pyrolysis process are mixed with room air and ignited by the upper heater in a combustion passage defined between the top wall and the partially lowered ram plate. The gases are ignited for flow through a catalyst to completely burn them by catalytic oxidation thereby eliminating smoke, odor and harmful pollutants; after which the burned gases are mixed with a relatively large quantity of outside air before being vented to the atmosphere.

These and other objects of the present invention will become apparent from the following description, reference being had to the accompanying drawings wherein a preferred embodiment of the present invention is clearly shown.

Figure 1:
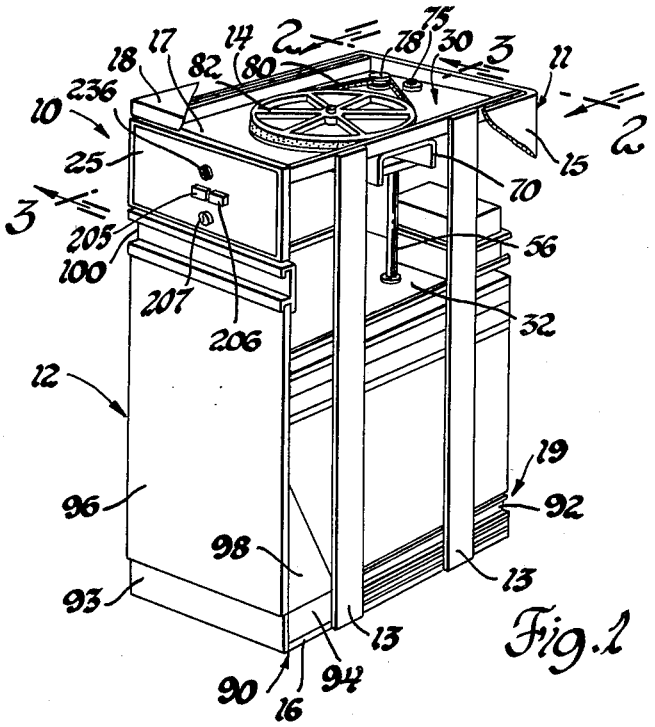
FIG. 1 is a perspective view with parts removed of the refuse compactor disposer of the invention with the receptacle drawer shown in the refuse compacting position.
Figure 2:
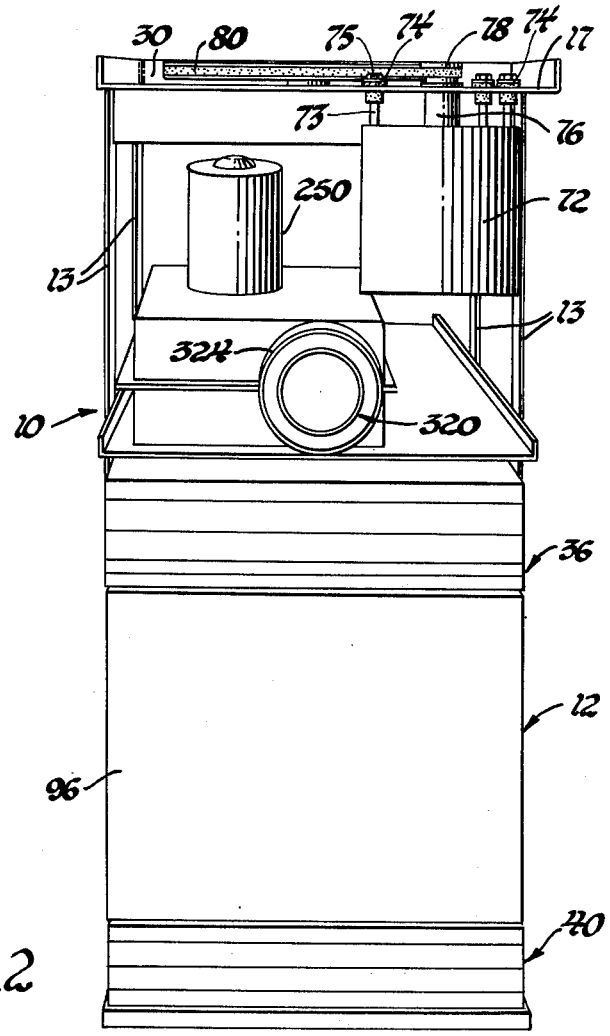
FIG. 2 is a rear view of the refuse compactor disposer with parts removed, partly in cross section.

Referring now more particularly to the drawings, and initially to FIGS. 1 and 2, there is shown a free-standing combination refuse or solid waste compactor-incinerator disposer, indicated generally at 10, comprising a housing 11 with a drawer assembly 12. The housing 11 includes vertically extending side frame members 13 covered by exterior opposed side panels 14 (FIG. 5), rear panel 15 (FIG. 6), a base 16, an upper wall 17, supporting a top deck or cutting board, partially indicated at 18 in FIG. 1. For details of a typical compactor housing reference may be had to U.S. Pat. No. 3,741,108 issued June 26, 1973 to Stratman, et al. The drawer 12 which includes a bottom carriage or frame 19 supported on slides 19' for movement into and out of the housing 11, serves to close the housing 11 front opening when the drawer is in its trash compacting position, being then in substantial alignment with the top front control panel 25.

The drawer assembly 12 provides a box-like refuse incinerator or pyrolysis chamber 20 defined in part by a rectangular sectioned sleeve 21 including a front wall 22, a rear wall 23 and opposed side walls 24 with each of the sleeve composite walls formed of layers of heat insulating refractory material which in the disclosed form includes four layers having a total thickness of about three inches. The drawer sleeve 21 is open ended with its top opening adapted to receive a metal refuse container 26, with the same having a generally tapered box-shaped configuration so as to be supported in the chamber 20 by means of its top peripheral flange 27 extending outwardly in overlying fashion on the top recessed edges 28 of the inner sleeve layers 29.

As seen in FIG. 1 the two pairs of opposed vertical frame members 13 are connected adjacent their lower edges to a downwardly directed peripheral flange on the base 16. Adjacent their upper edge, members 13 are connected to an upwardly turned peripheral flange on horizontal upper wall 17 which extends between the opposed pairs of side members and is subjacent to top deck 18. Upper wall 17, deck 18 and the upper portion of the front control panel 25 define therebetween a drive compartment indicated generally at 30.

Figure 3:
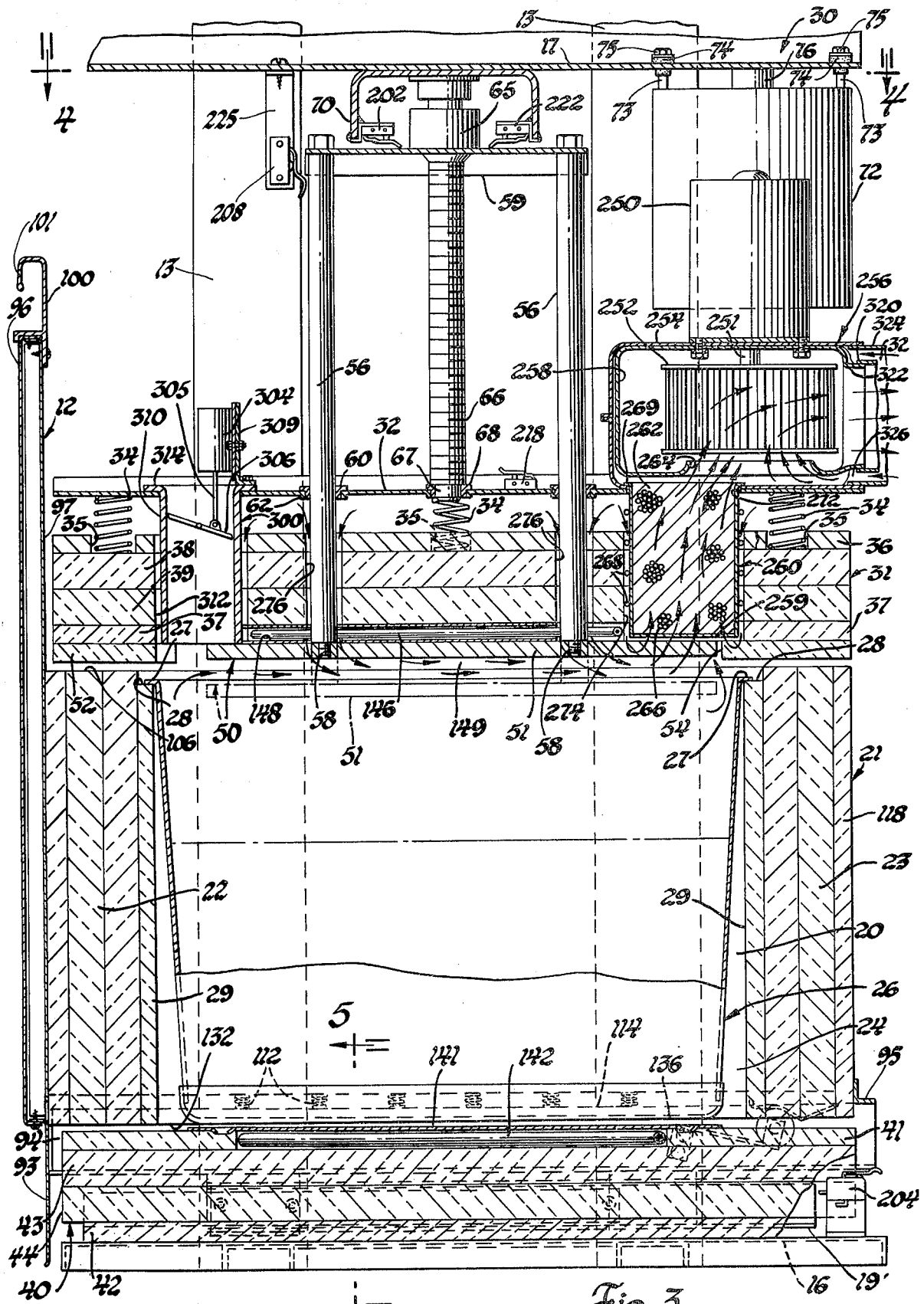
FIG. 3 is a transverse vertical sectional view (enlarged) taken along the line 3—3 of FIG. 1.
Figure 4:
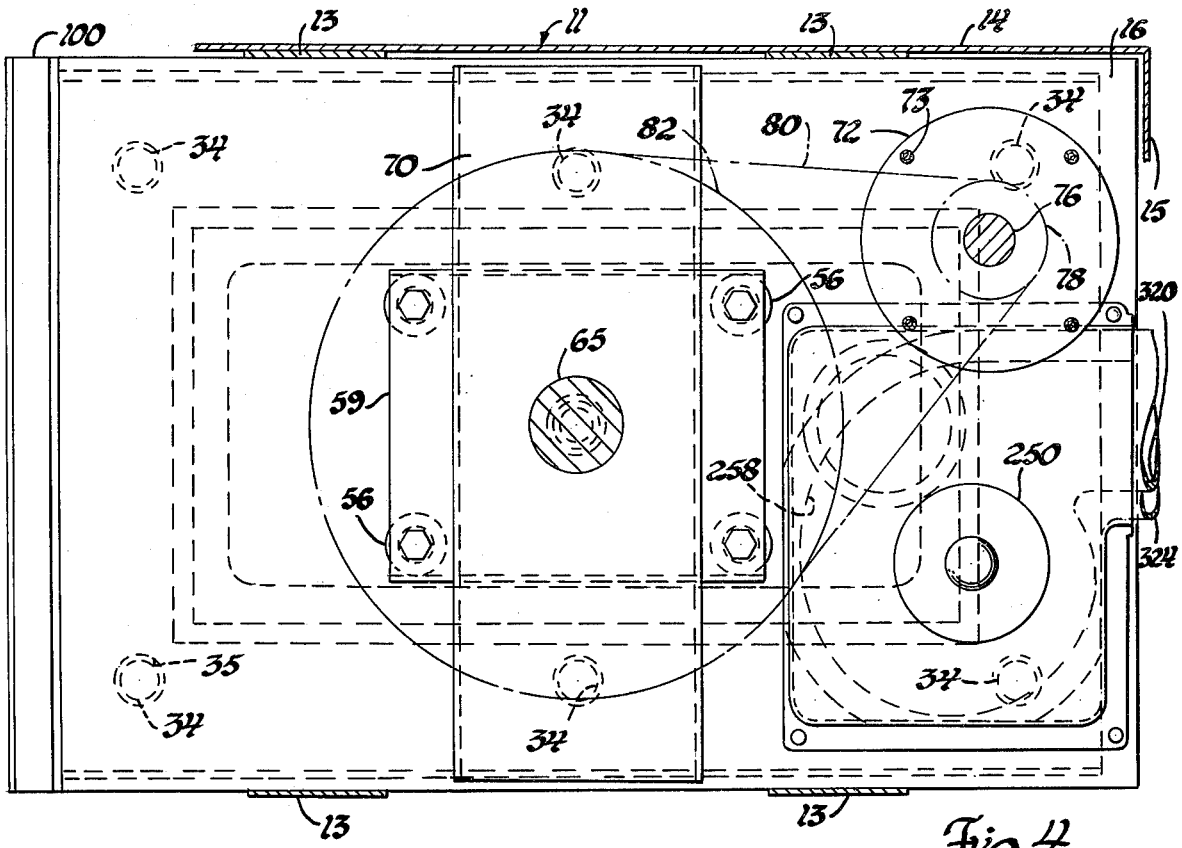
FIG. 4 is a horizontal sectional view taken along the line 4—4 of FIG. 3.

In FIG. 3 of the drawings, between the housing upper wall 17 and chamber top composite heat insulation wall 31, there is shown a horizontally extending guide partition 32 supported on the housing which provides a thrust plate for upper spring biasing means in the form of a plurality of upper compression coil springs 34. As seen in FIG. 4, the disclosed form includes six springs 34 arranged in two parallel longitudinal rows of three each. The lower end portions of the springs are received in circular bores 35 in the upper laminar slab 36 of top wall 31, preferably formed of rigid heat insulating or refractory material, such as that sold under the trade name of Marinite, with the springs 34 operative to exert a downward force on the top composite wall 31. The top refractory wall includes the top slab 36 and a lower slab 37 having sandwiched therebetween thicker slabs 38 and 39. A bottom stationary heat insulation composite wall, fixed on the housing base panel 16, is generally indicated at 40, and includes an upper chamber floor slab 41 and base slab 42 having sandwiched therebetween slabs 43 and 44. The front 22 and rear 23 walls, side walls 24, top wall 31 and bottom wall 40, each of which are about 3 inch thickness, define an enclosure forming the compacting and heating chamber 20 about 14 inches wide, 16.5 inches deep and 12.5 inches high in the preferred form.

Referring now to the compactor mechanism, a ram assembly, generally indicated at 50 in FIG. 3, includes pressure plate means in the form of a generally rectangular pressure or ram plate 51 which is adapted to be moved or elevated to its retracted position shown in full lines wherein the ram plate is raised within a rectangular refractory frame 52, being formed with a central rectangular cutout similar in shape to the ram plate defining a conforming rectangular recess 54. The ram includes motive means for driving the ram upwardly and downwardly within the container 26 along a stationary drive screw to be described. In its retracted position the ram plate 51 is received within recess 54 whereby the drawer 12 may be freely selectively slid between its open and closed positions. In its extended position the ram plate 51 is received within the container 26 to compact refuse placed therein.

As best shown in FIG. 3, ram assembly 50 comprises the ram plate 51 together with four vertical guide bars 56 rectangularly arranged around a central drive screw with the bars connected by threaded extensions 58 at their lower ends to the plate 51 and at their upper ends to cross member 59. Intermediate their ends, guide bars 56 are received for reciprocal sliding movement in sleeves 60 disposed within bosses 62 in guide partition 32, thereby to confine the bars 56 to rectilinear vertical motion.

Cross member 59 is provided with a centrally located, self-aligning sleeved nut, as shown in the mentioned Stratman et al. patent, mounted in sleeve 65 so that it can swivel to prevent binding. A threaded screw or drive rod 66 extends through the nut and is rotatably connected at its lower reduced end 67 in journal 68 to guide partition 32. At its upper end, screw 66 is rotatably received in and extends through transversely extending U-shaped member 70 and wall 17 into drive compartment 30. The threaded engagement between the sleeved nut and the screw 66 causes the cross member 59 and accordingly the ram plate 51 to move in a vertical reciprocal pattern, with the direction of such movement being dependent upon the direction of screw rotation.

As best shown in FIGS. 1 and 3, the drive means for rotating threaded screw 66 includes electric motor 72 mounted on wall 17 by bolts encased by spacers 73 and grommets 74, and threded in nuts 75. The motor shaft 76 has a relatively small diameter pulley 78 receiving drive belt 80, which in turn drives a relatively large pulley 82 suitably keyed to the top of the drive screw 66. Drive motor 72 is provided with an electrical control circuit (FIG. 7), operative upon actuation by a start button 206 on the control panel 25 sequentially to energize motor 72 to drive the ram plate 51 downwardly into container 26 until a preselected compressive force upon the refuse is obtained, to reverse the motor until the ram is withdrawn to its retracted position, and to automatically shut off motor 72, thereby to complete the compaction cycle.

Referring to FIGS. 1–3, the drawer 12 rectangular frame 90 includes side channel members 92, 94, front kickplate panel 93 and a rear angle 95. A Vertically and transversely oriented door, including an outer panel 96 and an inner panel 97, supported in its vertical position by triangular brackets, one of which is shown at 98 in FIG. 1, suitably secured to its associated side channel 94. Securing the top of the door panels 96 and 97 is a transversely extending trim strip 100 including a handle 101 to facilitate movement of the drawer 12 between its inner and outer positions.

The top wall biasing springs 34 are selected so that they are in their maximum compressed condition upon the ram plate 51 being raised to its full-up or retracted solid line position shown in FIG. 3. As the ram plate begins its downward compaction stroke it relieves the upward force exerted thereby on the top springs via top wall 31 thereby allowing the top springs 34 to exert a downward force on the top wall 31. Thus, with the drawer 12 in its compacting position, as the ram pressure plate 51 descends the top springs 34 will cause the top wall 36 to be lowered with the plate 51 until the top wall 36 contacts or seats against the upper edge 106 of the drawer wall sleeve assembly 21 as shown by dashed lines in FIG. 5. As the ram plate 51 continues its descent the top springs 34 provide a resultant downward force on the sleeve 21.

Figure 5:
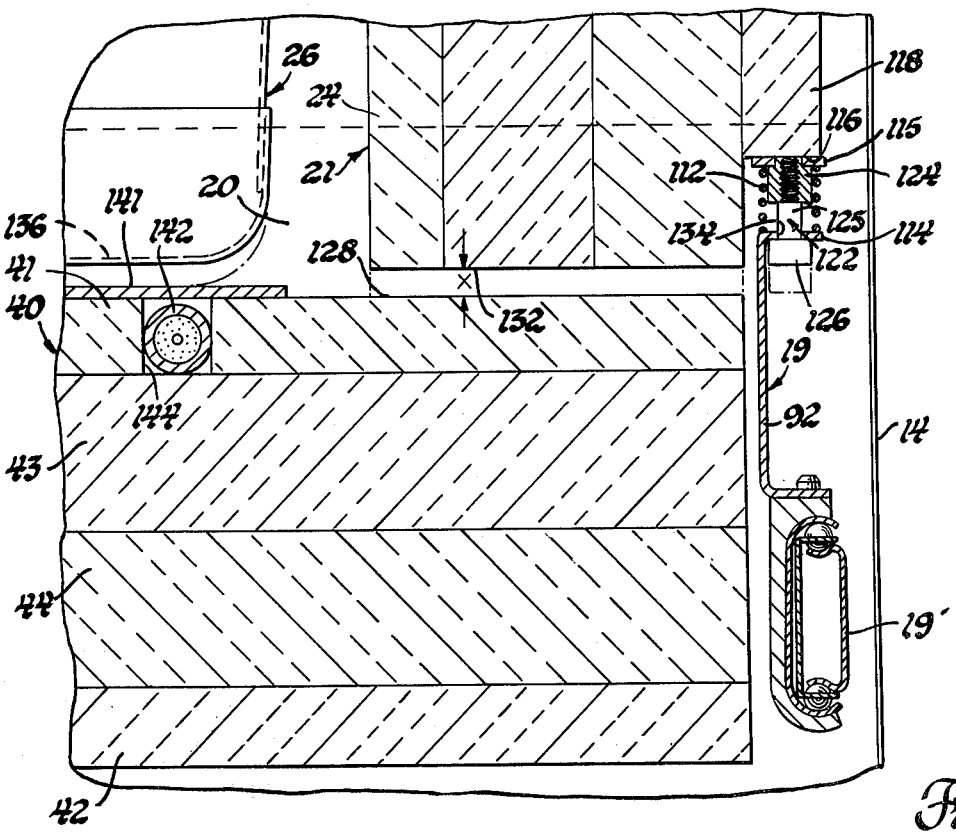
FIG. 5 is an enlarged fragmentary vertical sectional view taken along the line 5—5 of FIG. 3.

As best seen FIGS. 3 and 5, bottom spring biasing means, in the form of a plurality of coil compression springs 112, are supported on the upper horizontal flange 114 of side channel member 92 and resiliently support the drawer sleeve 21 by engaging the metal strip 115 secured on recessed bottom edge 116 of the outer insulation panel 118 of sleeve composite side wall 24. An identical set of coil springs (not shown) support the opposite side wall of the sleeve 21. The bottom springs 112, which in the disclosed form number six on each side, are selected so that with the ram plate 51 retracted bottom springs 112 exert enough force to resiliently support the combined weight of the sleeve and the container 26 together with a full load of refuse a defined distance "X" above floor slab 41 to allow the drawer to move in and out without contacting or dragging on the slab 41. As seen in FIG. 5 each spring 112 has a hold-down shouldered bolt, generally shown at 122, threaded up through a bushing 124 and metal edge strip 115, with the cylindrical bushing 124 telescopically receiving and locating the upper portion coil spring 112; while the lower end of the spring 112 seats against the upper face of flange 114. The bushing 124 is secured, as by welding, on the undersurface of strip 115 while the bolt head 126 normally seats on the underside of flange 114. The parts are sized so that a predetermined weight of the combined insulation sleeve 21 and trash filled container 26 are resiliently biased so as to be supported or "floated" the distance X when the bolt head 126 engages the flange 114. At this pre-ram descended load condition the bottom springs 112 exert sufficient upward bias force to support or float the total weight of the sleeve 21, the container or trash receptacle 26 and a full load of trash to achieve smooth translational movement of the drawer assembly on opposed slides 19'.

As the ram plate 51 is lowered into the container 26 the force of the top springs 34, acting through the sleeve 21, overcomes the force of the bottom springs 112 causing the bottom of the insulation sleeve 21, (exemplified by the bottom edge 132 of side wall 24) to contact the face 128 of the stationary floor slab 41 and establish a sealed pyrolysis or combustion chamber 20. It will be noted in FIG. 5 that the shouldered bolts 122 are free to reciprocate in flange holes 134 thereby allowing the lower springs 112 to be compressed while the bolts descend to their dashed line position. It will be appreciated that during a compaction and/or incineration cycle the container 26 is dimensioned vertically so that upon its bottom wall 136 seating on conduction base plate 141 its upper peripheral container flange 27 ceases to be supported on the recessed insulation sleeve wall peripheral edge 28 but rather is elevated a predetermined distance thereabove with the resulting force of ram plate 51 being transmitted directly, via the compacted trash, through the container bottom wall 136 to the wall 40 and appliance base panel 16.

As seen in FIGS. 3 and 5, combustion chamber lower heating means, shown in the preferred form as an electric oven type calrod or sheath heater 142, is located in a serpentine shaped longitudinal groove 144 in the floor slab 41. The heater 142 supplies heat to the container 26 through base plate 141 whereby heat flows primarily by conduction to the container bottom wall and its contents. Top heating means are provided, preferably in the form of top electrical calrod heater 146 also positioned in serpentine arranged recessed groove 148 in the top insulation slab 37.

Figure 7:
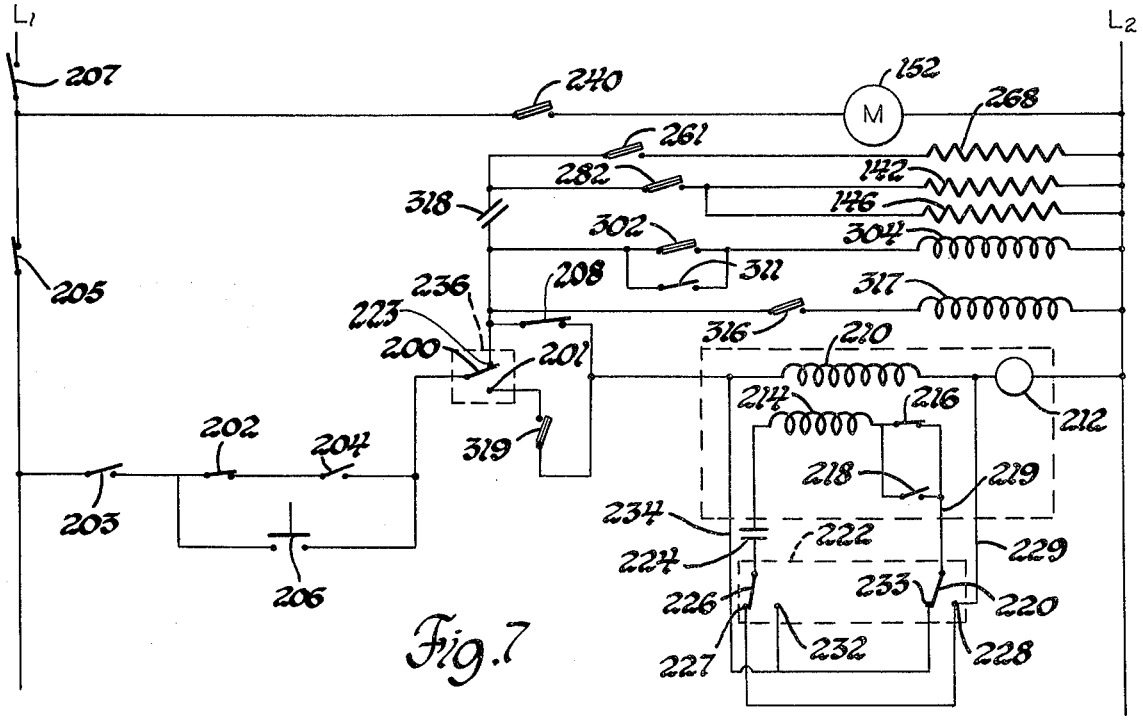
FIG. 7 is an electrical schematic drawing of the control system for the refuse compactor disposer.

Referring now to the schematic diagram of the control system shown in FIG. 7, conventional 120 volt 60 Hz input power is supplied at $L_1$ nd $L_2$. With the incinerate-compact switch blade 200 contacting compact contact 201 a circuit is established through the normally closed top limit microswitch 202, the normally closed drawer safety switches 203, 204, the stop switch 205, the start switch 206, and key actuated switch 207 to the main running winding 210 of the motor 72 and by way of a normally closed overload switch 212 to the terminal of second power line $L_2$. The motor 72 is preferably a split phase induction motor having the running winding 210, a start winding 214 and an internally connected centrifugal switch 216, which is of the conventional normally closed type, achieving an open condition upon the approach of the motor to a normal running speed.

In parallel connection with the centrifugal switch 216 is the normally open bottom limit switch 218 which is actuated to the closed condition when contacted by the drive or ram plate 50 at the bottom of the ram stroke. The centrifugal switch 216 is connected by way of line 219 to one pole 220 of the double-pole double-throw reversing switch 222, the start winding 214 being connected by way of capacitor 224 to the second pole 226 of the reversing switch, contacts 227 and 228 of the latter being connected to the $L_2$ side of the power source by way of line 229, the remaining contacts 232 and 233 being connected by way of line 234 indirectly to the $L_1$ side of the power source. The reversing switch 222 is located for actuation at the top of the ram stroke and the top limit switch 202 and the bottom limit switch 218 are in their open condition when the drive or ram plate 51 is at its uppermost position.

In operation if a compaction cycle is desired the operator moves a selector switch 236 on control panel 25 to COMPACT and pushes the START switch button 206 which, if key switch 207 is turned ON, power is routed via the motor 72 to start same for running in the downward direction. Initially, the ram plate 51 starts down allowing the top compression springs 34 to overcome the bias of the bottom springs 112 and seal the sleeve member 21 to the floor slab 41 while the top insulation wall 31 is spring biased downwardly and sealed to the upper edge portion 106 of the sleeve member 21. If the ram moves downward a predetermined distance of about ½ inch the top limit switch 202 will close, allowing the compactor to continue to run. Assuming the drawer is completely closed so that the drawer rear safety switch 204 is closed, the ram plate 51 will continue its descent to compact the refuse in the container. It will be noted that the ram motor reverse switch, shown at 222 in the FIG. 7 schematic, will have its contacts reset so that the start winding 214 will start the motor in its upward direction upon being energized again. The ram will continue to run down until one of the interlock switches is opened or until the motor is reversed.

In a compaction cycle upon the trash being compacted, the motor slows and stalls causing the centrifugal switch 216 to close, energizing the start winding 214 to initiate a reversal of the motor in the opposite (upward) direction. The ram 51 will continue to travel upward until it actuates the top limit switch 202, opening the circuit to the motor. About ¼ inch before the ram opens the top limit switch 202 to stop the unit it actuates the ram motor reversing switch 222 (FIG. 3) so that the motor can start in the downward direction the next time it is started.

If we assume that there is not enough trash in the container to cause the motor to stall and reverse itself the ram will close the bottom limit switch 218 at the bottom of the stroke actuating the start windings causing the motor to reverse.

If an incineration cycle is desired the operator moves the selector switch 236 to INCINERATE and push the START button causing the movable contact 200 to contact incinerate contact 223 and energize motor 72 windings via normally closed limit switch 208 support on bracket 225. The ram plate 51 is lowered to its dashed line position of FIG. 3 causing the limit switch 208 to be actuated by member 59 and opening switch 208, thereby deenergizing the motor 72. In the disclosed form the limit switch 208 positions the ram plate 51 about one inch below the bottom face of the top insulation wall 31 to establish the combustion zone or space 149. At this point, by means of the control circuit of FIG. 7, the bottom heater 142 and the top heater 146 are energized to start heating the chamber 20 and initiate incineration of the compacted trash in the container 26. It will be appreciated that the top heater 146 will also heat the adjacent ram plate 51 to an elevated temperature.

The initial heat input phase of the incineration cycle dries the trash by driving the moisture out of the trash and subsequently raises the refuse temperature to above about 180° F. at which point a normally open thermostatic switch 240 (FIG. 7), located in chamber 20, will close and energize the blower motor 250. The thermostatic switches, shown schematically in FIG. 7, which are preferably of the conventional gas filled bellows type are not shown in the drawings. Continued heating will cause the refuse to begin a destructive distillation process wherein the refuse will distil into different gaseous components. As seen in FIG. 3 the blower motor 250, with its vertical drive shaft 251 drivingly connected to a centrifugal blower wheel 252, is supported on the top wall 254 of exhaust air duct assembly 256 and with blower scroll housing 258 supported in spaced relation within the duct assembly.

The blower wheel 252, upon being driven, creates a negative pressure in the chamber 20 to pull the hot gases that are created therein into the inlet end 259 of a catalyst container, generally indicated at 260, having an upper exit 262 which communicates with the blower scroll housing inlet 264. Preferably the catalytic container 260 is filled with chromic oxide coated ceramic beads 266 of the type used, for example, in self-cleaning ovens. It will be noted, however, that other catalyst means, such as catalytic screens, described in U.S. Pat. No. 3,150,619, issued Sept. 29, 1964, to B. L. Brucken for a Domestic Incinerator, could be used without departing from the scope of the present invention.

Figure 6:
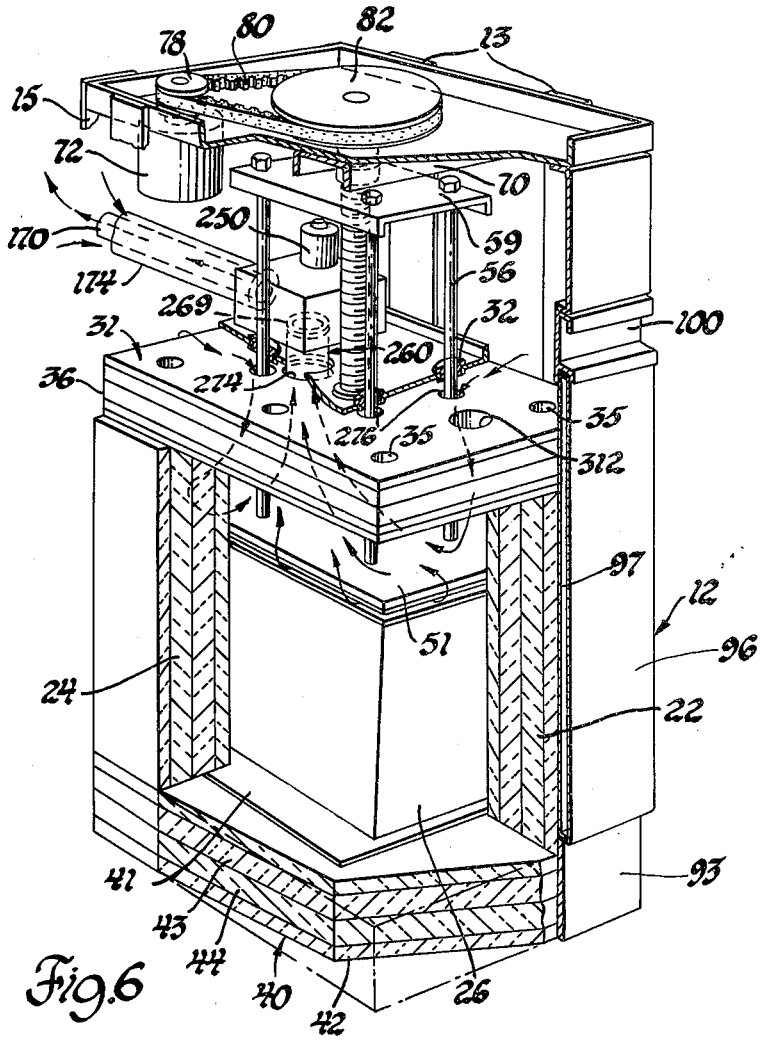
FIG. 6 is a partially diagrammatic perspective view of the refuse disposer compactor.

Catalyst heating means, in the form of an electric resistance heater 268, are provided in heat exchange relation around the exterior of the catalyst container 260. A normally closed thermostatically actuated switch 261 is provided to open at about 600° F. to provide immediate heating to the catalyst beads 266 to their actuating temperature to insure combustion will occur in the catalytic container prior to its achieving a self-heating temperature of about 600° F. As seen in FIGS. 3 and 6, the catalyst container 260 has an upper peripheral lip 269 secured as by welding to the periphery of aperture 272 in fixed guide plate 32. The catalyst container 260 is telescoped within an oversize concentric bore 274 in the top wall 31, allowing the wall 31 to move vertically, relative to the fixed container 260.

As the destructive distillation process proceeds, the residue within the container 26 will be reduced. Such reduction gives off a gaseous material which is volatile and combustible. During this reduction or distillation process, the operation of the blower fan 252 draws room air toward catalyst container inlet 259, downwardly through both the room air guide bar inlet openings 276 and the catalyst container opening 274. The room air drawn to the combustion flow passage 149, through the passageways 274 and 276, mingles with the volatile combustible products flowing in passage 149 due to pressure differential from the chamber 20. This convection heating will not cause volatile combustion products to leave the chamber 20 because a negative pressure is maintained within chamber 20 and such negative pressure, brought about by the blower 252, is effective to cause an egress of the volatile products into the plenum combustion passage 149. Once in the passage 149, the products of distillation comingle with the room air. This mixture is drawn across the heated ram plate 51 and raised to a temperature in excess of 1000° F. whereby the volatile materials are oxidized. A normally closed thermostatic switch 282 is provided in the circuit of heaters 142 and 146 which will open when the temperature in chamber 20 exceeds about 850° F. to deenergize the heaters and the heat of combustion is sufficient to maintain the temperature in chamber 20 above 850° F. It will be noted that the invention contemplates the provision of various additional control means (not shown) such as, for example, means to cycle the top heater 146 or means to deenergize the top heater 146 prior to deenergizing the bottom heater to control the combustion process and prevent a run-away condition from occurring in the chamber 20.

As the volatile burning gases are drawn through the catalyst container they increase the temperature of the beads to above 1200° F. At this point damper means in the form of a metered vent, generally indicated at 300 in FIG. 3, is opened by means of a thermally responsive normally open switch 302 (FIG. 7) which upon sensing a catalyst temperature above about 1300° closes to energize damper solenoid 304. The solenoid actuator 305 moves axially downward to open a damper valve plate 306 to increase room air flow into the combustion passage 149 thereby providing sufficient room air to insure complete combustion of the flue gases being generated while insuring that the catalyst is maintained at a temperature below about 1500° F. The metered vent 300 thus assists in preventing a run-away condition from occurring during the exothermic combustion process and destroying the catalyst. To this end holding means, preferably in the form of a microswitch 311 shown in the circuit of FIG. 7, is provided to maintain the damper 300 in its open condition during the remainder of the incineration cycle. It will be seen that the damper includes a cylindrical tube 310, supporting solenoid bracket 309, which is telescoped in a concentric bore 312 in the top wall 31 in a manner similar to the catalyst cylindrical container 260. The tube 310 also has a top lip flange secured as by welding to the guide plate 32 allowing the top wall 31 to move vertically relative to the fixed tube 310.

As seen in FIG. 7, a wide differential normally closed thermostatic switch 316 is provided which senses the temperature in the chamber 20 so as to open at about 1300° F. to deenergize coil 317 of relay indexing reset switch 318 and thereby removing the heaters 142, 146 and 268 from the circuit. Upon the temperature in the chamber 20 falling below about 700° F. the thermostatic switch 316 closes to energize coil 317 and reset switch 318 to its closed position for a subsequent incineration cycle. A safety normally closed thermostatic switch is provided at 319 in FIG. 7 to open at about 150° F. to deenergize the compact contact 201 to insure that no compacting cycle can be initiated during an incinerating cycle.

Any gases that are not burned in air passage 149 because of partial combustion are drawn into the catalyst chamber inlet 259 where the gases are oxidized and the liberation of heat will heat the beads 266 to insure that a complete combustion process occurs to cause the hydrocarbons to be burned to water vapor and carbon dioxide. Thus, as the gases exit the catalytic container at 262 and enter the blower intake 264 there are no pollutants remaining as they are completely combined with oxygen from the outside air.

As viewed in FIGS. 2, 3, 4 and 6, a cylindrical flue exhaust pipe 320 is connected to a flue collar 322 of the blower scroll or housing and extends rearwardly through the compactor-incinerator back wall 15 for connection to a suitable duct means for venting to the atmosphere. An outer vent pipe 324, preferably of the 4 in. diameter clothes dryer type, coaxially encircles the exhaust pipe 320 in spaced relation therewith to provide an outside or atmosphere air passage 326. The relatively cool outside air, which has been preheated by the exhaust gases in pipe 320, are mixed with the hot gases entering the blower scroll to comingle therewith and tempers the resultant temperature of the mixture to a degree which is suitable for being exhausted by the blower 252 through its outlet 322 to the atmosphere. As an example, the gases coming out of the catalyst may be of the order of 1200° F. and by virtue of mixing these gases with outside air the exhaust pipe gases are exited to the atmosphere at a temperature of about 150° F. This temperature reduction is achieved, in part, because of the heat interchange taking place with the discharged vent gases in pipe 320 losing some heat to the incoming outside air in passage 326.

While the embodiment of the present invention as herein disclosed constitutes a preferred form, it is to be understood that other forms might be adopted.

I claim:

1. A refuse compactor-incinerator appliance comprising a housing including a top and a base, an upper horizontally disposed partition spaced below said top dividing said housing into an upper drive chamber and a lower drawer space,, means for supporting a top insulation wall subjacent said partition for vertical movement, first spring means biasing said top wall in a downward direction, a lower insulation wall supported on said base, ram means including a ram plate mounted in said drawer space for vertically reciprocal movement, ram drive means in said drive chamber including means for vertically extending said ram plate into the drawer space and retracting said plate to an elevated position whereby said first spring means are compressed, electric motor means in said drive chamber having a driving connection with the drive means in said drive chamber for actuation of said ram means, means for supporting a drawer assembly on said housing for movement between a compacting-incinerating position in said housing and a position disposed outwardly of said housing, said drawer assembly including an open-ended insulated sleeve carried thereon, second spring means normally resiliently supporting said insulated sleeve a defined distance above said lower insulation wall and below said upper insulation wall, a refuse receptacle carried within said sleeve adapted to receive said ram plate, said ram plate when driven downwardly a predetermined distance allowing said first spring means to bias said upper insulation wall into abutting engagement with the upper end of said insulated sleeve, and said first spring means being of sufficient predetermined force to overcome the force of said second spring means causing said sleeve to move downwardly whereby its lower open end is placed in abutting engagement with said lower wall thereby defining an insulated combustion chamber.

2. A refuse compactor-incinerator domestic appliance comprising a housing including a top, a base, and opposed uprights extending between said top and base, an upper horizontally disposed guide partition spaced below said top defining an upper drive chamber and a lower drawer space, means for supporting a top insulation wall subjacent said partition for vertical movement, first compression coil spring means disposed between said guide partition and said top insulation wall, a lower insulation wall supported on said base, ram means including a ram plate mounted in said housing drawer space for vertically reciprocal movement therein, said ram means including vertically extending rods connected to said ram plate with each of the rods passing through an aperture in said top wall, ram drive means in said upper drive chamber including screw means for vertically extending said ram plate into the drawer space and retracting the same to an elevated position contacting the underside of said upper insulation wall whereby said first spring means are compressed, electric motor means in the housing drive chamber having a driving connection with the drive means in said drive chamber for such actuation of said ram plate, opposed drawer slides supported on said uprights slidably mounting a refuse receiving drawer assembly in said drawer space for translational movement between a compacting-incinerating position beneath said ram plate and a position disposed outwardly of said housing, said drawer assembly including an open-ended insulated sleeve carried thereon, second spring means supported on said drawer slides resiliently positioning said insulated sleeve a defined distance above said lower insulation wall when said ram plate is in its retracted position, said ram plate when in its elevated position compressing said first spring means whereby clearance spaces are provided between said drawer sleeve upper and lower ends and said upper and lower walls respectively, a refuse receptacle carried within said sleeve, said ram plate when driven downwardly by said drive means relieving the upwardly directed force on said upper wall whereby said first coil spring means biases said upper wall into engagement with said sleeve upper end, and whereby said first spring means being of sufficient predetermined force to overcome the upward force of said second spring means causing said sleeve to move downwardly into abutting engagement with said lower wall thereby defining a substantially airtight combustion chamber.

3. A refuse compactor-incinerator appliance comprising a housing including a top and a base, an upper horizontally disposed partition spaced below said top dividing said housing into an upper drive chamber and a lower drawer space, a top insulation wall parallel to and spaced beneath said partition for vertical movement, top heater means on the underside of said top wall, first spring means disposed between said partition and said top wall, a lower insulation wall supported on said base, a horizontally disposed ram plate in said drawer space, ram drive means in said drive chamber, apertures in said top all through which portions of said ram drive means extend for imparting vertically reciprocal movement to said ram plate between a lower compacting position, an incinerating position spaced a defined distance from said upper wall, and a retracted position contacting the underside of said upper wall to elevate same by compressing said first spring means; electric motor means in said drive chamber having a driving connection with the drive means in said drive chamber for such actuation of said ram plate, opposed slides supporting a drawer assembly on said housing for translational movement between a compacting-incinerating position in said housing and a position disposed outwardly of said housing, said drawer assembly including an open-ended insulated sleeve carried thereon, second spring means on said slides resiliently supporting said sleeve a defined distance above said lower wall and below said upper wall when said ram plate is in its retracted position, a refuse receiving receptacle carried within said sleeve adapted to receive said ram plate during its compacting cycle, said ram plate when driven downwardly to its incinerating position allowing said first spring means to bias said upper wall into abutting engagement with the upper open end of said sleeve, and said first spring means being of sufficient predetermined force to overcome the force of said second spring means causing said sleeve to move downwardly whereby its lower open end is placed in abutting engagement with said lower wall thereby defining an insulated substantially airtight combustion chamber within said sleeve, bottom heater means in said lower wall for causing incineration of combustibles deposited within said receptacle, fan means for drawing in room air through the top wall apertures and for exhausting a mixture of room air and the flue gases at temperatures relatively cooler than the products of combustion, control circuit means including a selector switch operative for selecting either a compaction cycle or an incineration cycle, said selector switch when positioned for said last-named cycle operative, after said ram plate has compacted the refuse in said receptacle, to raise said plate to said incinerating position spaced below said upper insulation wall a predetermined distance defining a volatile combustion passage therebetween; and said combustion passage being in communication with the flue gases exiting from said combustion chamber, whereby said top heater means heating the flue gases to an ignition temperature range such that most of the combustion products in the flue gases are consumed.

4. A refuse compactor-incinerator appliance comprising a housing including a top and a base, an upper horizontally disposed partition spaced below said top dividing said housing into an upper drive chamber and a lower drawer space, a top insulation wall parallel to and spaced beneath said partition for vertical movement, top heater means on the underside of said top wall, first resilient means biasing said top wall in a downward direction, a lower insulation wall supported on said base, a horizontally disposed ram plate in said drawer space, ram drive means in said drive chamber, apertures in said top wall through which portions of said ram drive means extend for imparting vertically reciprocal movement to said ram plate between a lower compacting position, an incinerating position spaced from said upper wall, and a retracted position contacting the underside of said upper wall to elevate same by compressing said first spring means; electric motor means in said drive chamber having a driving connection with the drive means in said drive chamber for such actuation of said ram plate, means supporting a drawer assembly on said housing for movement between a position in said housing and a position disposed outwardly of said housing, said drawer assembly including an open-ended insulated sleeve carried thereon, second resilient means supporting said sleeve a defined distance above said lower all and below said upper wall when said ram plate is in its retracted position, a refuse receiving receptacle carried within said sleeve adapted to receive said ram plate during its compacting cycle, said first resilient means, operative upon said ram plate being driven downwardly to its incinerating position, biasing said upper wall into abutting engagement with the upper open end of said sleeve; and said first resilient means being of sufficient force to overcome said second resilient means causing said sleeve to move downwardly whereby its lower open end abuts said lower wall thereby defining an insulated substantially airtight combustion chamber, bottom heater means in said lower wall for causing incineration of combustibles in said receptacle, fan means for drawing in room air through the top wall apertures into said chamber, control circuit means including a selector switch operative for selecting either a compaction cycle or an incineration cycle, said selector switch when positioned for said last-named cycle causing said control circuit means to move said ram plate to a position spaced below said upper wall whereby a volatile combustion passage is provided, said passage being in communication with the flue gases exiting from said receptacle whereby said top heater means will heat said ram plate and the gases flowing through said passage to an ignition temperature range such that most of the combustion products in the flue gas are consumed, damper means operative for providing for the flow of additional room air into said passage, a catalyst chamber having catalyst means therein to oxidize the flue gases, said catalyst chamber having an inlet communicating with said passage and an outlet communicating with the inlet of said fan means, and said control circuit means including thermostatic switch means operative to open said damper means at a predetermined temperature range to increase the flow of room air into said passage whereby the flue gases entering said catalyst chamber are maintained below a predetermined temperature thereby preventing the overheating of said catalyst means.

* * * * *